US012546102B2

(12) United States Patent
Corona

(10) Patent No.: US 12,546,102 B2
(45) Date of Patent: Feb. 10, 2026

(54) LINEAR OR TRENCH DRAIN SYSTEMS

(71) Applicant: Advanced Drainage Systems, Inc., Hilliard, OH (US)

(72) Inventor: Ariel Corona, West Chester, OH (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 470 days.

(21) Appl. No.: 18/309,877

(22) Filed: May 1, 2023

(65) Prior Publication Data

US 2024/0287783 A1 Aug. 29, 2024

Related U.S. Application Data

(60) Provisional application No. 63/447,801, filed on Feb. 23, 2023.

(51) Int. Cl.

| | |
|---|---|
| ***E03F 5/04*** | (2006.01) |
| ***E01C 11/22*** | (2006.01) |
| ***E03F 5/06*** | (2006.01) |

(52) U.S. Cl.

CPC ..... *E03F 5/0401* (2013.01); *E01C 11/227* (2013.01); *E03F 5/06* (2013.01)

(58) Field of Classification Search

None

See application file for complete search history.

(56) References Cited

U.S. PATENT DOCUMENTS 59,804 A * 11/1866 Whitehead ..... E03F 5/046 404/4
63,284 A * 3/1867 Miller ..... E03F 5/0404 210/163
319,112 A * 6/1885 Nevius ..... E01C 11/223 138/108
355,330 A * 1/1887 Locke ..... E01C 11/223 138/108

(Continued)

FOREIGN PATENT DOCUMENTS

DE 102004019920 A1 * 11/2005 ..... E03F 3/046
EP 2995732 B1 * 3/2020 ..... E03F 5/04
WO WO-2024178243 A1 * 8/2024 ..... E01C 11/227

OTHER PUBLICATIONS

Advanced Drainage Systems, Inc., *Technical Note TB 2.11 Duraslot Burial Depth and Backfill Conditions,* Mar. 2022, retrieved Apr. 27, 2023, from https://www.adspipe.com/water-management-solutions/inlets-and-basins/duraslot-slotted-drain-pipe (4 pages).

(Continued)

*Primary Examiner* — Robert J Popovics

(74) *Attorney, Agent, or Firm* — FINNEGAN, HENDERSON, FARABOW, GARRETT & DUNNER L.L.P.

(57) ABSTRACT

A drainage apparatus for fluid runoff comprising one or more grates and a frame having a top portion configured to accommodate the one or more grates. The frame includes a first plurality of plates located within the frame and positioned below the one or more grates. One or more cross members are connected to plates of the first plurality of (Continued)

plates, each of the one or more cross members extends between at least two plates of the first plurality of plates. Each of the one or more grates is secured to a cross member of the one or more cross members.

20 Claims, 5 Drawing Sheets

(56) References Cited

U.S. PATENT DOCUMENTS

RE10,980 E * 1/1889 Locke ..... 404/3
469,044 A * 2/1892 Jungbluth ..... A01K 1/0103 404/2
494,620 A * 4/1893 Bedgood ..... E01C 11/227 404/2
543,740 A * 7/1895 Kuhns ..... E03F 5/0404 210/163
630,533 A * 8/1899 Fiske ..... A01K 1/0151 119/528
669,495 A * 3/1901 Babcock ..... E04D 13/076 248/48.1
775,791 A * 11/1904 Austin ..... E01C 11/223 404/2
814,308 A * 3/1906 Marriott ..... E03F 5/046 404/4
888,753 A * 5/1908 Schodde ..... E03F 3/046 405/118
973,442 A * 10/1910 Lees ..... E03F 3/046 405/118
1,406,068 A * 2/1922 Padgett ..... E01C 9/02 238/178
1,426,736 A * 8/1922 Hess ..... E04C 2/425 5/264.1
1,428,230 A * 9/1922 Hess ..... E04C 2/425 105/457
1,444,198 A * 2/1923 Mcqueary ..... 404/2
2,026,498 A * 12/1935 Hohorst ..... E03F 5/04 210/164
2,031,779 A * 2/1936 Ladd ..... B21D 47/005 52/669
2,084,118 A * 6/1937 Zabriskie ..... E04C 2/425 52/667
2,182,795 A * 12/1939 Day ..... E03F 5/0404 210/434
2,386,020 A * 10/1945 Wendelken ..... E01C 11/227 D25/164
2,396,735 A * 3/1946 Leigh ..... F24F 13/08 52/799.14
2,436,593 A * 2/1948 Moselowitz ..... E01C 11/221 D25/164
2,649,720 A * 8/1953 Heltzel ..... E01C 11/227 404/2
2,701,027 A * 2/1955 Scoville ..... E03F 5/0401 220/DIG. 25
2,938,437 A * 5/1960 Daley ..... E03F 5/046 285/125.1
3,221,616 A * 12/1965 Flegel ..... E03F 5/046 49/464
3,225,545 A * 12/1965 Flegel ..... E01C 11/227 404/2
3,393,614 A * 7/1968 Peletz ..... E01C 11/223 404/4
3,465,654 A * 9/1969 Fox ..... E01C 11/106 52/126.2
3,626,823 A * 12/1971 Toth ..... E01C 11/223 405/36
3,666,104 A * 5/1972 Aprill, Jr. ..... E01C 11/227 210/477
3,714,786 A * 2/1973 Evans ..... E02B 11/005 405/49
3,788,756 A * 1/1974 Ito ..... E01D 19/086 404/4
3,815,213 A * 6/1974 Evans ..... E01C 11/227 29/446
3,876,322 A * 4/1975 Deason ..... E04H 4/141 210/163
3,882,743 A * 5/1975 Evans ..... E02B 11/005 83/156
3,898,778 A * 8/1975 Erickson ..... E04G 11/04 264/32
3,945,746 A * 3/1976 Bredbenner ..... E03F 5/06 210/163
4,007,566 A * 2/1977 Molitor ..... E04H 4/1227 52/169.7
4,136,010 A * 1/1979 Pilie ..... E03F 5/0401 210/164
4,142,329 A * 3/1979 Williams ..... E05B 65/006 49/465
D259,950 S * 7/1981 Henry ..... D23/259
4,365,911 A * 12/1982 Rossberg ..... E01C 11/227 404/2
4,367,142 A * 1/1983 Blecher ..... E03F 5/06 52/302.1
4,382,414 A * 5/1983 Svirklys ..... B65D 19/0097 24/294
4,407,055 A * 10/1983 Rossberg ..... E01C 11/224 29/890.14
4,451,172 A * 5/1984 Lamphier ..... E01C 11/227 405/126
4,472,078 A * 9/1984 Karbstein ..... E01C 11/227 404/2
4,490,067 A * 12/1984 Dahowski ..... E01C 11/227 52/169.5
4,494,891 A * 1/1985 Hauer ..... E03F 5/06 210/163
4,498,807 A * 2/1985 Kirkpatrick ..... E03F 3/046 210/163
4,515,498 A * 5/1985 Thomann ..... E01C 11/227 D25/155
4,553,874 A * 11/1985 Thomann ..... E01C 11/227 52/662
4,560,302 A * 12/1985 Karbstein ..... E01C 11/227 404/2
4,561,801 A * 12/1985 Nantz ..... E02B 5/00 405/15
RE32,248 E * 9/1986 Blecher ..... E03F 5/06 52/302.1
4,621,939 A * 11/1986 Thomann ..... E01C 11/227 404/4
4,630,962 A * 12/1986 Thomann ..... E01C 11/227 210/163
4,630,966 A * 12/1986 Karbstein ..... E01C 11/227 138/155
4,640,643 A * 2/1987 Williams ..... E01C 11/227 405/118
4,699,544 A * 10/1987 Karbstein ..... E01C 11/227 138/155
4,751,945 A * 6/1988 Williams ..... F16L 1/028 174/101
4,787,773 A * 11/1988 Kehler ..... E01C 11/227 405/36
4,815,888 A * 3/1989 Stegmeier ..... E04F 15/14 404/4
4,838,727 A * 6/1989 Capuano ..... E01C 11/227 404/2
4,844,655 A * 7/1989 Aleshire ..... E03F 3/046 52/741.11
4,878,782 A * 11/1989 Beattie ..... E02B 13/00 405/119
4,883,394 A * 11/1989 Van der Woude .... E02D 29/124 411/908
4,940,359 A * 7/1990 Van Duyn ..... E01C 11/227 405/126
4,952,094 A * 8/1990 Spiess ..... E02D 29/1427 405/36
4,955,752 A * 9/1990 Ferns ..... E03F 5/06 52/507

(56) References Cited

U.S. PATENT DOCUMENTS

RE33,439 E * 11/1990 Thomann ..... E01C 11/227 210/163
4,968,170 A * 11/1990 Wilson ..... E04C 2/423 52/669
4,986,693 A * 1/1991 Salberg ..... E01C 11/223 404/98
4,993,877 A * 2/1991 Beamer ..... E01C 19/506 405/282
4,993,878 A * 2/1991 Beamer ..... E01C 19/506 405/282
5,000,621 A * 3/1991 Beamer ..... E03F 3/046 405/282
5,024,550 A * 6/1991 Mainville ..... E03F 5/06 210/163
5,026,202 A * 6/1991 Thomann ..... E01C 11/227 404/5
5,039,263 A * 8/1991 Meyer ..... E02D 29/124 411/908
5,066,165 A * 11/1991 Wofford ..... E03F 3/046 405/118
5,106,231 A * 4/1992 Thomann ..... E01C 11/227 405/36
5,110,235 A * 5/1992 Thomann ..... E03F 5/06 49/465
5,130,016 A * 7/1992 Gavin ..... E03F 5/06 210/164
5,133,619 A * 7/1992 Murfae ..... B01D 24/12 404/5
5,135,331 A * 8/1992 Steiner ..... A63C 19/00 404/32
5,179,752 A * 1/1993 Clough ..... E03F 5/06 14/74
5,181,793 A * 1/1993 Dekel ..... E01C 11/227 404/47
5,213,438 A * 5/1993 Barenwald ..... E03F 3/046 405/118
5,226,748 A * 7/1993 Barenwald ..... E02B 5/00 405/121
5,234,582 A * 8/1993 Savoie ..... E04D 13/0409 52/12
D339,415 S * 9/1993 Kiras ..... D23/397
5,256,000 A * 10/1993 Beamer ..... E03F 3/046 404/2
5,281,051 A * 1/1994 Stegall ..... E03F 3/046 405/118
5,281,052 A * 1/1994 Beamer ..... E03F 3/046 249/11
5,320,445 A * 6/1994 Farrelly ..... E03F 5/06 404/26
5,324,135 A * 6/1994 Smith ..... E02D 29/1463 292/149
5,326,189 A * 7/1994 Beamer ..... E02D 27/02 405/118
5,326,190 A * 7/1994 Beamer ..... E03F 3/046 405/118
5,340,234 A * 8/1994 Rossi ..... E01C 11/227 405/48
5,372,457 A * 12/1994 Rante ..... E02B 11/005 52/155
5,372,714 A * 12/1994 Logue, Jr. ..... E03F 5/0404 404/5
5,380,121 A * 1/1995 Schluter ..... E01C 11/227 210/164
5,393,171 A * 2/1995 Stegall ..... E03F 3/046 405/118
5,399,047 A * 3/1995 Stegall ..... E03F 3/046 405/118
5,409,602 A * 4/1995 Sorenson ..... E04D 13/0767 52/12
5,437,516 A * 8/1995 Sauerwein ..... F16B 21/075 411/509
5,443,327 A * 8/1995 Akkala ..... E03F 3/046 405/118
5,454,663 A * 10/1995 Stegmeier ..... E04H 4/1227 52/169.5
5,462,382 A * 10/1995 Sauerwein ..... E01C 11/227 49/463
5,462,383 A * 10/1995 Van 'T Veer ..... E01C 11/227 404/4
5,463,786 A * 11/1995 Mangone ..... E01D 19/125 404/70
5,466,091 A * 11/1995 Sauerwein ..... E02D 29/1427 405/36
5,468,096 A * 11/1995 Sauerwein ..... E02D 29/1427 405/36
5,478,169 A * 12/1995 Stegall ..... E03F 3/046 249/11
5,489,163 A * 2/1996 Thomann ..... E03F 5/0408 405/126
5,522,675 A * 6/1996 Gunter ..... E03F 3/046 24/336
5,529,436 A * 6/1996 Meyers ..... E03F 3/046 405/118
5,538,361 A * 7/1996 Beamer ..... E03F 3/046 249/11
5,564,857 A * 10/1996 Schluter ..... E02B 11/005 405/36
5,564,860 A * 10/1996 Amann ..... E03F 5/06 411/549
5,568,995 A * 10/1996 Beamer ..... E03F 3/046 405/118
5,573,351 A * 11/1996 Beamer ..... E03F 3/046 404/4
5,575,925 A * 11/1996 Logue, Jr. ..... E03F 5/0404 404/5
5,613,804 A * 3/1997 Beamer ..... E03F 3/046 405/118
5,645,367 A * 7/1997 Gunter ..... E03F 3/046 404/2
5,647,689 A * 7/1997 Gunter ..... E03F 3/046 405/36
5,647,692 A * 7/1997 Gunter ..... E01C 11/227 473/278
5,653,553 A * 8/1997 Gunter ..... E02B 5/00 405/36
5,702,204 A * 12/1997 Gunter ..... E03F 3/046 405/118
5,718,537 A * 2/1998 Becker ..... E01C 11/227 405/121
5,729,937 A * 3/1998 Mantelli ..... E03F 3/046 52/169.7
5,735,637 A * 4/1998 Gunter ..... E03F 3/046 405/36
5,735,638 A * 4/1998 Beamer ..... E03F 3/046 405/118
5,779,393 A * 7/1998 Gunter ..... E01C 13/08 405/121
5,803,662 A * 9/1998 Gunter ..... E01C 13/00 405/36
5,810,513 A * 9/1998 Beamer ..... E01C 11/227 405/118
5,839,852 A * 11/1998 Mattson ..... E01C 11/225 14/2.4
5,853,265 A * 12/1998 Gunter ..... E01C 11/227 404/4
5,879,106 A * 3/1999 Beamer ..... E03F 3/046 249/11
5,882,145 A * 3/1999 Beamer ..... E01C 11/227 249/11
5,890,839 A * 4/1999 Gunter ..... E04G 15/06 405/118
5,908,266 A * 6/1999 Miller ..... E01C 11/227 405/36
5,934,828 A * 8/1999 Hu ..... E02B 11/00 405/36
5,971,662 A * 10/1999 Becker ..... E03F 3/046 404/2

(56) References Cited

U.S. PATENT DOCUMENTS 6,000,881 A * 12/1999 Becker ..... E03F 3/046 405/52
6,004,068 A * 12/1999 Hosley ..... E04G 9/08 405/118
6,027,283 A * 2/2000 Schweinberg ..... E03F 3/046 405/118
6,113,311 A * 9/2000 Becker ..... E01C 11/227 405/121
6,129,838 A * 10/2000 Millner ..... E04D 13/0459 52/302.1
6,132,137 A * 10/2000 Gunter ..... E01C 13/08 405/121
6,141,916 A * 11/2000 Shackelford ..... E03F 3/046 52/12
6,170,095 B1 * 1/2001 Zars ..... E04H 4/1236 4/507
6,170,796 B1 * 1/2001 Gunter ..... E03F 3/046 249/144
6,220,784 B1 * 4/2001 Bricker ..... E03F 3/046 249/11
6,230,468 B1 * 5/2001 Klaus ..... E02D 31/06 52/287.1
6,234,711 B1 * 5/2001 Beaman ..... E01C 11/223 249/8
6,280,117 B1 * 8/2001 Obermeyer ..... E02B 11/00 405/36
6,294,095 B1 * 9/2001 Lewis ..... E03F 1/00 210/477
6,298,621 B1 * 10/2001 Lee ..... E02D 5/185 52/60
6,443,656 B1 * 9/2002 Gunter ..... E01C 19/506 403/324
6,533,497 B2 * 3/2003 Gunter ..... E01C 19/506 403/324
6,595,720 B2 * 7/2003 Humphries ..... E03F 3/046 405/118
6,612,780 B2 * 9/2003 Dahowski ..... E03F 3/046 210/170.1
6,663,317 B1 * 12/2003 Williams ..... E03F 3/046 405/48
6,729,795 B2 * 5/2004 Dahowski ..... E04H 4/1227 404/4
6,746,179 B1 * 6/2004 Kerkhoff ..... A01K 1/0103 405/41
6,792,723 B2 * 9/2004 Stegmeier, Sr. ..... E03F 3/046 52/302.3
6,793,439 B1 * 9/2004 Arm ..... E03F 5/06 24/297
6,860,678 B2 * 3/2005 Gunter ..... E03F 3/046 405/122
6,869,525 B1 * 3/2005 Happel ..... E03F 1/00 210/163
6,905,285 B2 * 6/2005 Little ..... E01C 11/227 405/36
6,908,256 B1 * 6/2005 Humphries ..... E03F 5/06 210/163
6,942,419 B2 * 9/2005 Knak ..... E03F 5/06 210/163
6,945,733 B2 * 9/2005 Rathmann ..... E03F 5/06 405/122
6,974,540 B1 * 12/2005 Fleischmann ..... E03F 1/00 210/163
6,986,621 B2 * 1/2006 Allard ..... B01D 29/27 405/36
7,008,137 B2 * 3/2006 Muller ..... E01C 11/225 405/38
7,048,466 B2 * 5/2006 Benesteau ..... E01C 11/227 210/164
7,059,804 B2 * 6/2006 Sieber ..... E03F 3/046 405/118
7,066,685 B2 * 6/2006 Humphries ..... E04C 2/427 210/163
7,121,759 B2 * 10/2006 Woodson ..... E01C 9/10 210/164
7,125,506 B2 * 10/2006 Humphries ..... E03F 3/046 405/118
7,144,185 B2 * 12/2006 Messerschmidt ..... E03F 5/06 210/164
7,172,368 B2 * 2/2007 Wallace ..... E01C 19/506 249/11
7,201,533 B2 * 4/2007 DeGreef ..... E03F 5/06 404/25
7,246,472 B2 * 7/2007 Nielsen ..... E03F 5/0408 52/302.1
7,252,457 B2 * 8/2007 Humphries ..... H02G 3/0608 405/35
7,264,418 B1 * 9/2007 Houck ..... E03F 3/046 405/47
7,303,669 B2 * 12/2007 Monneret ..... E02D 29/1427 210/474
7,306,401 B1 * 12/2007 Linkogle ..... E02B 5/02 405/118
7,393,153 B2 * 7/2008 Woodson ..... E04C 2/425 210/164
7,413,372 B2 * 8/2008 Meyers ..... E03F 3/046 404/2
D582,527 S * 12/2008 Wang ..... D23/267
7,506,844 B2 * 3/2009 Humphries ..... E03F 3/046 405/35
7,507,054 B2 * 3/2009 Fithian ..... E03F 3/046 405/80
7,524,133 B2 * 4/2009 Messerschmidt ..... E03F 5/06 404/4
7,534,071 B2 * 5/2009 Humphries ..... H02G 3/0608 248/48.1
7,588,392 B2 * 9/2009 Wroblewski ..... E03F 5/06 210/163
7,617,644 B2 * 11/2009 Nielsen ..... E03F 5/0407 4/679
7,632,042 B2 * 12/2009 Brafford, Jr. ..... E03F 5/0408 249/11
7,637,694 B1 * 12/2009 Musser ..... E01C 11/227 405/36
7,637,695 B1 * 12/2009 Akkala ..... E03F 3/046 405/118
7,670,080 B2 * 3/2010 Tzaig ..... E02D 29/12 210/170.03
7,670,084 B2 * 3/2010 Aristeo, Jr. ..... B28B 19/0038 52/220.2
7,686,540 B2 * 3/2010 Urriola ..... E01C 11/228 405/53
7,703,502 B2 * 4/2010 Wallace ..... E01C 19/506 428/587
7,736,092 B2 * 6/2010 Hodgekins ..... E04G 15/061 249/11
7,774,870 B2 * 8/2010 Griffin ..... E04H 4/1236 4/507
7,780,855 B2 * 8/2010 Eberly ..... E03F 5/16 210/747.3
7,794,176 B2 * 9/2010 Musser ..... E03F 3/046 52/302.3
7,866,911 B2 * 1/2011 Saadi ..... E03F 3/046 404/2
7,879,233 B2 * 2/2011 Shaw ..... E03F 5/0404 210/164
7,909,531 B2 * 3/2011 Shaw ..... E01C 23/0933 405/36
7,914,229 B2 * 3/2011 Aubusson ..... E03F 5/06 4/510
7,931,421 B2 * 4/2011 Rathmann ..... E03F 5/06 404/2
7,955,027 B2 * 6/2011 Nourian ..... E03F 3/046 405/122
7,967,523 B2 * 6/2011 Hetzler ..... E03F 3/046 405/118
8,075,219 B2 * 12/2011 Greville ..... E03F 5/06 404/2

(56) References Cited

U.S. PATENT DOCUMENTS 8,122,674 B2 * 2/2012 Bartley ..... E04C 2/425 52/177
8,211,298 B2 * 7/2012 Pendleton ..... E03F 5/06 404/5
8,239,974 B2 * 8/2012 Erlebach ..... E03F 5/04 4/290
8,240,946 B2 * 8/2012 Applefield ..... E01C 11/227 405/36
8,272,807 B2 * 9/2012 Shaw ..... E01C 23/0933 405/36
8,292,541 B2 * 10/2012 Akkala ..... E03F 5/06 210/164
D672,015 S * 12/2012 Luke ..... D23/261
8,322,944 B2 * 12/2012 Hodgekins ..... E01C 11/227 405/118
8,419,311 B2 * 4/2013 Shaw ..... E01C 23/0933 404/5
8,469,625 B2 * 6/2013 White ..... E01C 11/08 404/2
8,469,631 B2 * 6/2013 Santi ..... E01C 11/227 405/118
8,474,068 B2 * 7/2013 Kik, Sr. ..... E03F 5/0408 4/679
8,475,079 B2 * 7/2013 Humphries ..... E03F 3/046 249/11
8,486,260 B2 * 7/2013 Tripodi ..... E03F 5/14 210/232
8,505,131 B2 * 8/2013 Doolittle ..... E03F 5/0408 405/118
8,544,219 B1 * 10/2013 Janesky ..... E04B 1/7023 52/302.3
8,678,710 B2 * 3/2014 Dos Santos ..... E03F 3/046 405/118
8,708,603 B2 * 4/2014 Kerkhoff ..... E03F 3/046 405/184.4
8,734,051 B2 * 5/2014 Kerkhoff ..... E03C 1/12 405/184.4
8,826,613 B1 * 9/2014 Chrien ..... H02G 3/383 52/127.2
8,850,633 B2 * 10/2014 Erlebach ..... E03F 5/04 4/679
8,894,324 B2 * 11/2014 Cucchiara ..... E03F 3/046 405/118
8,911,175 B2 * 12/2014 Koerner ..... E03F 3/046 405/80
8,920,072 B2 * 12/2014 Humphries ..... E03F 3/046 404/4
8,959,858 B1 * 2/2015 Francisco ..... E03F 5/04 52/302.3
8,967,190 B2 * 3/2015 Keizers ..... E03F 5/0407 137/362
8,992,115 B2 * 3/2015 Shaw ..... E03F 3/02 404/5
9,045,874 B1 * 6/2015 Kondas ..... E02D 31/025
9,127,446 B2 * 9/2015 Schlueter ..... E03F 5/04
9,200,464 B1 * 12/2015 Blake ..... E04H 4/00
9,206,593 B2 * 12/2015 Tripodi ..... E03F 5/14
9,220,392 B2 * 12/2015 Morrison ..... B01D 29/01
9,334,638 B1 * 5/2016 Kirby ..... A47K 3/40
9,382,701 B2 * 7/2016 Meyers ..... E03F 5/0407
9,469,956 B2 * 10/2016 Koerner ..... E02B 11/00
9,469,982 B2 * 10/2016 Belanger ..... B60S 13/00
9,506,234 B2 * 11/2016 Files, Jr. ..... E03F 3/046
9,567,738 B2 * 2/2017 Schlueter ..... E03F 5/04
9,611,634 B2 * 4/2017 Erlebach ..... E03F 5/0408
9,617,723 B2 * 4/2017 Stonecipher ..... E03F 5/06
D787,028 S * 5/2017 Gomo ..... D23/267
9,643,113 B2 * 5/2017 Farmer ..... E03C 1/264
9,644,363 B2 * 5/2017 Meyers ..... E03F 5/06
9,718,008 B2 * 8/2017 Peresan ..... B01D 33/0346
9,739,044 B1 * 8/2017 Files, Jr. ..... E03F 3/046
9,739,045 B1 * 8/2017 Jones ..... A47K 3/00
9,765,563 B1 * 9/2017 LaPree ..... E06B 7/08
9,777,489 B2 * 10/2017 Gomo ..... E03F 5/0407
9,784,028 B1 * 10/2017 LaPree ..... E06B 3/70
9,822,494 B1 * 11/2017 Bartley, II ..... E04C 2/423
9,834,894 B1 * 12/2017 Reed ..... E03F 5/0407
9,903,105 B2 * 2/2018 Tomberlin ..... E03F 5/0411
9,932,730 B2 * 4/2018 Files, Jr. ..... E03F 5/06
9,970,188 B2 * 5/2018 Torras-Pique ..... E03F 5/0404
9,995,032 B2 * 6/2018 Meyers ..... E03F 5/0407
10,017,933 B1 * 7/2018 Kirby ..... E03F 5/0408
10,047,511 B2 * 8/2018 Eftekharzadeh ..... E03B 11/10
10,047,512 B2 * 8/2018 Chromey ..... E03F 3/046
10,052,570 B2 * 8/2018 Braun ..... B01D 21/2483
10,060,117 B1 * 8/2018 Marshall ..... E03F 5/0402
10,087,586 B2 * 10/2018 Murphy, III ..... C02F 1/285
10,105,017 B2 * 10/2018 Clear ..... E03F 5/0407
10,132,070 B2 * 11/2018 Madler ..... E01C 11/227
10,165,905 B2 * 1/2019 Sander ..... E03F 5/0408
10,167,621 B2 * 1/2019 Priester ..... E06B 1/70
10,184,239 B2 * 1/2019 Meincke ..... E04C 2/421
10,240,332 B1 * 3/2019 Stetson ..... E02B 11/005
10,240,351 B2 * 3/2019 Gomo ..... E03F 5/06
10,260,223 B2 * 4/2019 Erlebach ..... E03F 5/0408
10,352,032 B2 * 7/2019 Dian ..... E03F 5/06
10,384,155 B1 * 8/2019 DiLalla ..... E03F 5/0404
10,400,436 B2 * 9/2019 Steylaerts ..... E03C 1/284
10,434,442 B2 * 10/2019 Peresan ..... B01D 33/03
10,501,926 B2 * 12/2019 Priester ..... E03F 5/0407
10,508,429 B2 * 12/2019 Casey ..... E06B 7/14
10,544,576 B2 * 1/2020 Ismert ..... E03F 5/0401
10,550,563 B1 * 2/2020 Kozlowski ..... E03C 1/22
10,570,628 B2 * 2/2020 Gomo ..... E03F 5/0407
10,590,611 B2 * 3/2020 Kim ..... E01C 11/22
10,604,925 B2 * 3/2020 Blamble ..... E03F 5/0409
10,676,910 B2 * 6/2020 Simon ..... E01C 11/227
10,697,168 B2 * 6/2020 Kozlowski ..... E03F 5/0408
10,724,225 B2 * 7/2020 Brill ..... E03F 5/0408
10,738,494 B1 * 8/2020 Krombein ..... E04H 4/1218
10,753,077 B2 * 8/2020 Coppola ..... C02F 1/004
10,765,267 B2 * 9/2020 Secher ..... A47K 3/30
10,774,517 B2 * 9/2020 Chromey ..... E03F 3/046
10,786,765 B2 * 9/2020 DiLalla ..... B01D 29/27
10,829,922 B2 * 11/2020 Brill ..... E03F 5/0408
10,882,772 B1 * 1/2021 Wensel ..... E03F 5/101
D909,544 S * 2/2021 Pohl ..... E03F 5/06 D23/261
10,920,410 B2 * 2/2021 Wadaga ..... E03F 5/0407
RE48,488 E * 3/2021 Belanger ..... E03F 3/046
10,975,583 B2 * 4/2021 Gomo ..... B66B 13/301
11,015,331 B1 * 5/2021 Kang ..... E03F 5/04
D921,167 S * 6/2021 Pohl ..... E03F 5/06 D23/261
11,021,864 B1 * 6/2021 Mjelde ..... E04H 4/06
D924,374 S * 7/2021 Pohl ..... E03F 5/06 D23/261
11,053,674 B2 * 7/2021 Dian ..... E01C 11/227
11,072,916 B2 * 7/2021 Coy ..... E03F 5/0408
11,072,921 B1 * 7/2021 Mjelde ..... E03F 3/046
11,078,658 B2 * 8/2021 Say ..... E03F 5/0411
11,131,069 B2 * 9/2021 Priester ..... E01F 5/00
11,149,429 B2 * 10/2021 Gomo ..... E03F 5/0409
11,241,121 B2 * 2/2022 Brill ..... A47K 3/40
11,312,042 B2 * 4/2022 Brafford, Jr. ..... E04G 13/021
11,312,647 B1 * 4/2022 Wensel ..... E03F 5/0404
11,319,698 B2 * 5/2022 Coy ..... E03F 5/0409
11,384,499 B2 * 7/2022 Luke ..... E03F 3/046
11,408,164 B2 * 8/2022 Gomo ..... E04F 17/00
11,427,997 B2 * 8/2022 Brill ..... E03F 5/0408
11,454,017 B2 * 9/2022 Larson ..... E03F 5/0408
11,459,744 B2 * 10/2022 Swope ..... C02F 1/001
11,473,287 B2 * 10/2022 Blamble ..... E03F 5/0409
11,505,930 B2 * 11/2022 Meyers ..... E03F 5/0408
11,536,016 B2 * 12/2022 Schluter ..... E03F 5/0408
11,549,254 B1 * 1/2023 Mjelde ..... E03F 5/0401
11,607,085 B2 * 3/2023 Cook ..... A47K 3/40
11,612,245 B2 * 3/2023 Meiser ..... A47B 96/021 211/134
11,613,883 B2 * 3/2023 Bernoti ..... E03F 5/0408 210/163

(56) References Cited

U.S. PATENT DOCUMENTS 11,617,476 B2 * 4/2023 Welch ..... E03F 5/0408 4/613
11,629,085 B1 * 4/2023 Wensel ..... C02F 9/00 210/170.03
11,655,626 B2 * 5/2023 Meyers ..... A47K 3/40 4/612
11,655,627 B2 * 5/2023 Steinbacher ..... E03F 3/046 210/164
11,661,732 B2 * 5/2023 Gomo ..... E03F 5/0407 4/679
11,674,320 B2 * 6/2023 Gomo ..... E03F 5/06 52/302.1
D993,366 S * 7/2023 DiBacco ..... D23/261
D994,087 S * 8/2023 Strum ..... D23/261
D994,088 S * 8/2023 Strum ..... D23/261
D994,089 S * 8/2023 Strum ..... D23/261
11,746,517 B2 * 9/2023 Kristjansson ..... E03F 3/046 405/119
11,773,580 B2 * 10/2023 Schluter ..... E03F 5/04 4/292
11,795,629 B2 * 10/2023 Wong ..... E03F 5/14
11,795,703 B2 * 10/2023 Ghazalah ..... E04F 19/10
11,808,020 B2 * 11/2023 Robillard ..... E03C 1/26
11,808,024 B2 * 11/2023 Nivelles ..... E03F 5/0409
11,825,994 B2 * 11/2023 Brill ..... A47K 3/40
11,873,635 B2 * 1/2024 Wedi ..... E03F 5/0408
11,905,697 B2 * 2/2024 Valore ..... E03F 5/041
11,913,213 B2 * 2/2024 Larson ..... E03F 5/0408
11,933,034 B2 * 3/2024 Meincke ..... E03F 5/04
D1,024,282 S * 4/2024 DiBacco ..... D23/261
11,976,455 B2 * 5/2024 Gannon ..... E03F 5/0404
12,006,677 B2 * 6/2024 Stokes ..... E03F 5/04
12,018,489 B2 * 6/2024 Majocka ..... E04D 13/0409
12,059,104 B2 * 8/2024 Keizers ..... A47K 3/008
12,116,767 B2 * 10/2024 Blamble ..... E03F 5/0409
12,203,259 B1 * 1/2025 Sacks ..... E03F 5/0408
12,215,493 B1 * 2/2025 Lawrence ..... E03F 1/002
12,247,385 B2 * 3/2025 Wild ..... E03F 5/0408
12,286,783 B2 * 4/2025 Stoltenberg ..... E03F 5/06
12,290,217 B2 * 5/2025 Welch ..... A47K 3/40
12,297,126 B1 * 5/2025 Anguiano ..... C02F 1/283
12,320,112 B2 * 6/2025 Gomo ..... E04F 17/00
12,334,720 B2 * 6/2025 Manabe ..... E03F 5/06
12,366,063 B2 * 7/2025 Say ..... E03F 5/041
12,404,683 B2 * 9/2025 Gomo ..... E03F 5/0407
2002/0057945 A1 * 5/2002 Dahowski ..... E03F 5/06 405/118
2002/0113025 A1 * 8/2002 Gauldin ..... E03F 5/0401 210/767
2002/0121466 A1 * 9/2002 McDermott ..... B01D 17/0202 210/164
2002/0154952 A1 * 10/2002 Gunter ..... E01C 19/506 405/121
2002/0159838 A1 * 10/2002 Allard ..... E03F 5/0404 405/43
2003/0082009 A1 * 5/2003 Humphries ..... E03F 3/046 405/118
2003/0111397 A1 * 6/2003 Stegmeier, Sr. ..... E03F 3/046 52/302.1
2003/0115814 A1 * 6/2003 Nielsen ..... E03F 5/0406 52/302.1
2003/0147693 A1 * 8/2003 Knak ..... E03F 5/06 404/4
2003/0228193 A1 * 12/2003 Little ..... E03F 3/046 405/36
2004/0005194 A1 * 1/2004 Williams ..... E03F 3/046 405/43
2004/0062602 A1 * 4/2004 Dahowski ..... E04H 4/1227 404/2
2004/0081515 A1 * 4/2004 Wallace ..... E01C 19/506 52/11
2004/0136785 A1 * 7/2004 Gunter ..... E03F 3/046 405/36
2005/0025567 A1 * 2/2005 Bricker ..... E03F 3/046 404/2
2005/0025572 A1 * 2/2005 Sanfilippo ..... E03F 3/046 405/36
2005/0055887 A1 * 3/2005 Benesteau ..... E01C 11/227 52/11
2005/0100409 A1 * 5/2005 Houck ..... E03F 3/046 405/125
2005/0100412 A1 * 5/2005 Houck ..... E03F 3/046 405/125
2005/0196238 A1 * 9/2005 DeGreef ..... E03F 5/06 404/25
2005/0230295 A1 * 10/2005 Monneret ..... E03F 5/06 404/5
2005/0232701 A1 * 10/2005 Humphries ..... E04C 2/427 405/43
2005/0238435 A1 * 10/2005 Wallace ..... E01C 19/506 249/11
2005/0238436 A1 * 10/2005 Wallace ..... E01C 19/506 249/11
2005/0281619 A1 * 12/2005 Humphries ..... E03F 3/046 405/122
2006/0048469 A1 * 3/2006 MacLean ..... E03F 5/0402 52/220.3
2006/0157985 A1 * 7/2006 Dahowski ..... E03F 3/046 285/405
2006/0239773 A1 * 10/2006 Meyers ..... E01C 11/227 404/2
2007/0071554 A1 * 3/2007 Stoltengerg ..... B28B 7/18 405/43
2007/0099782 A1 * 5/2007 Saadi ..... E03F 3/046 493/2
2007/0144954 A1 * 6/2007 Neuber ..... E03F 5/06 210/163
2007/0177942 A1 * 8/2007 Meyers ..... E03F 3/046 405/40
2007/0261166 A1 * 11/2007 Burns ..... E03C 1/22 4/665
2007/0274781 A1 * 11/2007 Aubusson ..... E03F 5/06 405/36
2007/0293008 A1 * 12/2007 Hodgekins ..... E04G 21/185 438/270
2008/0005835 A1 * 1/2008 Shipley ..... E03F 5/0407 4/695
2008/0014022 A1 * 1/2008 Wroblewski ..... E03F 5/06 405/119
2008/0019776 A1 * 1/2008 Fithian ..... E03F 3/046 405/118
2008/0022617 A1 * 1/2008 Nielsen ..... E03F 5/0406 52/302.6
2008/0025797 A1 * 1/2008 Brafford, Jr. ..... E03F 5/0407 405/118
2008/0025798 A1 * 1/2008 Humphries ..... E03F 3/046 405/121
2008/0095582 A1 * 4/2008 Aristeo ..... E03F 3/046 405/119
2008/0193217 A1 * 8/2008 Akkala ..... E03F 5/06 405/43
2008/0232900 A1 * 9/2008 Shimono ..... E03F 5/06 404/4
2009/0080970 A1 * 3/2009 Shaw ..... E01C 11/227 404/2
2009/0097921 A1 * 4/2009 Hetzler ..... E03F 3/046 405/119
2009/0103982 A1 * 4/2009 Hodgekins ..... E04G 15/061 405/118
2009/0202302 A1 * 8/2009 Koenig ..... E03F 3/046 405/43
2009/0241440 A1 * 10/2009 Musser ..... E03F 3/046 52/741.1
2009/0241442 A1 * 10/2009 MacLean ..... A01K 1/0151 52/302.1
2009/0266754 A1 * 10/2009 Pendleton ..... B22C 7/04 210/163
2010/0008718 A1 * 1/2010 Cooper ..... E01C 19/4886 404/2

(56) References Cited

U.S. PATENT DOCUMENTS

2010/0061805 A1* 3/2010 Nourian ..... E03F 3/046 405/36
2010/0162481 A1* 7/2010 Erlebach ..... E03F 5/0408 4/679
2011/0016622 A1* 1/2011 Dallmer ..... E03F 5/06 4/286
2011/0023978 A1* 2/2011 Keizers ..... E03F 5/0407 137/362
2011/0047695 A1* 3/2011 Niedens ..... E03F 5/04 4/679
2011/0061161 A1* 3/2011 Erlebach ..... E03F 5/0408 4/679
2011/0067175 A1* 3/2011 Steylaerts ..... E03F 5/0408 4/679
2011/0091281 A1* 4/2011 Cucchiara ..... E01C 13/02 405/47
2011/0097146 A1* 4/2011 Applefield ..... E03F 3/046 404/4
2011/0135384 A1* 6/2011 Shaw ..... E01C 23/0933 404/72
2011/0162137 A1* 7/2011 Kik, Sr. ..... E03F 3/046 29/428
2011/0182666 A1* 7/2011 Brinkschulte ..... E03F 3/046 405/45
2011/0203979 A1* 8/2011 Schlueter ..... E03F 5/0408 210/164
2011/0204529 A1* 8/2011 Kerkhoff ..... F16L 3/00 264/34
2011/0303595 A1* 12/2011 Larsson ..... E03F 5/0408 210/164
2012/0110827 A1* 5/2012 Doolittle ..... E03F 5/0408 29/527.1
2012/0180294 A1* 7/2012 Doolittle ..... E04F 15/02188 29/428
2012/0180295 A1* 7/2012 Doolittle ..... E04F 15/02188 29/428
2012/0180296 A1* 7/2012 Doolittle ..... E04F 15/02188 29/428
2012/0180415 A1* 7/2012 Doolittle ..... E04F 15/02188 52/302.1
2012/0183352 A1* 7/2012 Humphries ..... E03F 3/046 405/36
2012/0198778 A1* 8/2012 MacLean ..... E04F 17/00 52/302.1
2012/0288330 A1* 11/2012 Altinier ..... E01C 11/227 405/43
2012/0315085 A1* 12/2012 Shaw ..... E01C 23/0933 404/2
2013/0199978 A1* 8/2013 Luke ..... E03F 5/06 210/163
2013/0209166 A1* 8/2013 Shaw ..... E01C 11/227 404/2
2013/0318704 A1* 12/2013 Plank ..... E03F 5/0408 29/428
2013/0326806 A1* 12/2013 Stonecipher ..... E03F 5/06 29/428
2014/0033423 A1* 2/2014 Cook ..... B29C 45/14065 264/275
2014/0060668 A1* 3/2014 Kerkhoff ..... F16L 3/00 137/356
2014/0110007 A1* 4/2014 Humphries ..... E03F 3/046 29/428
2014/0217644 A1* 8/2014 Brafford, Jr. ..... B29C 39/02 249/177
2014/0332453 A1* 11/2014 Torras-Pique ..... E01C 11/227 210/170.03
2014/0352815 A1* 12/2014 Brodey ..... E03F 5/0409 137/544
2015/0040500 A1* 2/2015 Francisco ..... E04H 4/1227 52/302.3
2015/0233081 A1* 8/2015 Dau ..... E02D 29/14 404/26
2015/0233628 A1* 8/2015 Farmer ..... B01D 35/02 210/166
2015/0240464 A1* 8/2015 Meyers ..... E03F 5/041 210/460
2015/0247312 A1* 9/2015 Brodey ..... E03F 5/0407 404/26
2015/0308092 A1* 10/2015 Chromey ..... E03F 3/046 137/363
2015/0330068 A1* 11/2015 Schlueter ..... E03F 5/0408 210/163
2015/0342420 A1* 12/2015 Secher ..... A47K 3/40 29/428
2016/0130794 A1* 5/2016 Erlebach ..... E03F 5/0408 4/613
2016/0174773 A1* 6/2016 Summers ..... E03F 5/0408 4/613
2016/0194861 A1* 7/2016 Nivelles ..... E03F 5/0408 285/42
2016/0281346 A1* 9/2016 Clear ..... E03F 5/0407
2016/0289913 A1* 10/2016 Canney ..... E05B 35/008
2016/0298324 A1* 10/2016 Blamble ..... E03F 3/046
2016/0305109 A1* 10/2016 Meyers ..... E03F 5/041
2016/0319530 A1* 11/2016 Files, Jr. ..... E03F 3/046
2016/0319531 A1* 11/2016 Files, Jr. ..... E03F 3/046
2016/0340889 A1* 11/2016 Tomberlin ..... E03F 5/0404
2016/0362883 A1* 12/2016 Simon ..... E03F 5/0404
2016/0369491 A1* 12/2016 Eftekharzadeh ..... E03F 3/046
2017/0175374 A1* 6/2017 Funari ..... E01C 11/227
2017/0196413 A1* 7/2017 Sander ..... E03F 5/0408
2017/0211267 A1* 7/2017 Stonecipher ..... E03F 5/0408
2017/0218613 A1* 8/2017 Jones ..... A47K 3/00
2017/0226728 A1* 8/2017 Meyers ..... E03F 5/06
2017/0241121 A1* 8/2017 Files, Jr. ..... E01C 11/227
2017/0241124 A1* 8/2017 Erlebach ..... A47K 3/008
2017/0241145 A1* 8/2017 Gomo ..... E03F 5/0407
2017/0314251 A1* 11/2017 Madler ..... E03F 3/046
2017/0314252 A1* 11/2017 Steylaerts ..... E03F 5/0408
2017/0356195 A1* 12/2017 Gomo ..... E03F 5/0407
2018/0038091 A1* 2/2018 Ismert ..... E03F 5/0401
2018/0087260 A1* 3/2018 Priester ..... E06B 1/70
2018/0110379 A1* 4/2018 Wadaga ..... A47K 3/40
2018/0155915 A1* 6/2018 Meyers ..... E03F 5/041
2018/0209131 A1* 7/2018 Dian ..... E01C 11/227
2018/0209132 A1* 7/2018 Dian ..... E03F 5/0401
2018/0245328 A1* 8/2018 Marshall ..... E03F 5/046
2018/0320357 A1* 11/2018 Chromey ..... E03F 3/046
2018/0320358 A1* 11/2018 Chromey ..... E03F 3/046
2018/0340319 A1* 11/2018 Schlüter ..... E03C 1/14
2018/0363284 A1* 12/2018 Casey ..... E03F 5/0407
2019/0024358 A1* 1/2019 Meincke ..... E01C 11/223
2019/0032323 A1* 1/2019 Priester ..... E03F 5/0407
2019/0055727 A1* 2/2019 Jones ..... E03F 5/0408
2019/0106874 A1* 4/2019 Brill ..... E03C 1/22
2019/0169831 A1* 6/2019 Wadaga ..... E03F 5/0408
2019/0169860 A1* 6/2019 Gomo ..... E04F 17/00
2019/0211540 A1* 7/2019 Bernoti ..... E03F 5/0408
2019/0211541 A1* 7/2019 Brill ..... E03F 5/0408
2019/0226194 A1* 7/2019 Stetson ..... E03F 3/046
2019/0316341 A1* 10/2019 Say ..... E03F 3/04
2020/0029747 A1* 1/2020 Wadaga ..... E03F 5/0408
2020/0063413 A1* 2/2020 Coy ..... E03C 1/22
2020/0149261 A1* 5/2020 Kozlowski ..... E03F 5/0408
2020/0173179 A1* 6/2020 Gomo ..... E04F 17/00
2020/0208392 A1* 7/2020 Stetson ..... E03F 3/046
2020/0214510 A1* 7/2020 Brill ..... E03F 5/0408
2020/0217055 A1* 7/2020 Robillard ..... E03F 5/0407
2020/0217059 A1* 7/2020 Blamble ..... E03F 5/0409
2020/0291628 A1* 9/2020 Meyers ..... A47K 3/405
2021/0040721 A1* 2/2021 Larson ..... E03F 5/0408
2021/0076880 A1* 3/2021 Welch ..... A47K 3/40
2021/0102348 A1* 4/2021 Priester ..... E01F 5/00
2021/0115655 A1* 4/2021 Brill ..... E03F 5/0408
2021/0156132 A1* 5/2021 Stetson ..... E03F 5/06
2021/0180308 A1* 6/2021 Gomo ..... E04B 1/34861
2021/0189712 A1* 6/2021 Schluter ..... E03F 5/0407
2021/0230886 A1* 7/2021 Gomo ..... B66B 13/301
2021/0282553 A1* 9/2021 Meiser ..... F16B 5/0016
2021/0293010 A1* 9/2021 Coy ..... E03F 5/0408

(56) References Cited

U.S. PATENT DOCUMENTS

2021/0301518 A1* 9/2021 Meyers ..... A47K 3/40
2021/0317627 A1* 10/2021 Luke ..... E02B 5/02
2021/0355670 A1* 11/2021 Say ..... E03F 5/041
2021/0355671 A1* 11/2021 Schluter ..... E03F 5/0408
2021/0363742 A1* 11/2021 Valore ..... A47K 3/40
2021/0372112 A1* 12/2021 Gunter ..... E01C 19/506
2021/0381216 A1* 12/2021 Stokes ..... E03F 5/04
2022/0034077 A1* 2/2022 Gomo ..... E03F 5/0407
2022/0120073 A1* 4/2022 Meincke ..... E03F 5/04
2022/0127835 A1* 4/2022 Meincke ..... E03F 3/06
2022/0127836 A1* 4/2022 Wild ..... E03F 5/0408
2022/0145607 A1* 5/2022 McDonald ..... E03F 5/14
2022/0160182 A1* 5/2022 Brill ..... E03F 5/0408
2022/0192433 A1* 6/2022 Cook ..... A47K 3/40
2022/0195712 A1* 6/2022 Wedi ..... F16J 15/106
2022/0218159 A1* 7/2022 Keizers ..... A47K 3/008
2022/0243484 A1* 8/2022 Ghazalah ..... B66B 13/301
2022/0349170 A1* 11/2022 McKnight ..... C02F 1/004
2022/0356693 A1* 11/2022 Kristjansson ..... E03F 5/0402
2022/0364349 A1* 11/2022 Gomo ..... E03F 5/06
2022/0364350 A1* 11/2022 Stetson ..... E03F 5/06
2022/0372744 A1* 11/2022 Steinbacher ..... E02D 29/1427
2022/0389703 A1* 12/2022 Muller ..... E03F 5/06
2023/0003011 A1* 1/2023 Stoltenberg ..... E03F 5/06
2023/0035222 A1* 2/2023 Blamble ..... E03F 3/046
2023/0054583 A1* 2/2023 McKee ..... E03F 5/041
2023/0085447 A1* 3/2023 Larson ..... E03F 5/0408
4/679
2023/0210315 A1* 7/2023 Maheu ..... E03F 5/0409
4/613
2023/0216287 A1* 7/2023 Manabe ..... H02G 9/04
174/68.3
2023/0218124 A1* 7/2023 Welch ..... E03F 5/0408
4/613
2023/0220633 A1* 7/2023 Wong ..... E01C 11/227
2023/0228078 A1* 7/2023 Egli ..... A47K 3/405
4/613
2023/0257985 A1* 8/2023 Gomo ..... E03F 5/06
4/679
2023/0265664 A1* 8/2023 Gomo ..... E04F 17/00
52/302.1
2023/0322582 A1* 10/2023 Ridell ..... G01N 33/18
210/600
2024/0011228 A1* 1/2024 Boere ..... E03F 3/046
2024/0068223 A1* 2/2024 Altunc ..... E03F 5/0408
2024/0125106 A1* 4/2024 Pontarelli ..... E03F 3/046
2024/0159037 A1* 5/2024 MacDonald ..... E03F 5/0408
2024/0191492 A1* 6/2024 Swanson ..... E03F 5/06
2024/0247478 A1* 7/2024 Twaroski ..... E03F 3/046
2024/0271406 A1* 8/2024 Creighton ..... E03F 5/06
2024/0287783 A1* 8/2024 Corona ..... E03F 3/046
2024/0295112 A1* 9/2024 Stokes ..... E03F 5/0408
2024/0318417 A1* 9/2024 Larson ..... E03F 5/0408
2025/0012069 A1* 1/2025 Hallgren ..... E03F 5/06
2025/0034855 A1* 1/2025 Blamble ..... E03F 5/0408
2025/0122713 A1* 4/2025 Blamble ..... E03F 5/0408
2025/0129592 A1* 4/2025 Peters, Jr. ..... E03F 5/0404
2025/0177887 A1* 6/2025 Sedmík ..... E03F 5/06
2025/0243656 A1* 7/2025 Hallgren ..... E03F 5/06
2025/0250786 A1* 8/2025 Dangerfield ..... E03F 5/04

OTHER PUBLICATIONS

Advanced Drainage Systems, Inc., *4" Duraslot 2½" Slot Riser Submittal Package,* Nov. 2017, retrieved Apr. 27, 2023, from https://www.adspipe.com/water-management-solutions/inlets-and-basins/duraslot-slotted-drain-pipe (10 pages).

Advanced Drainage Systems, Inc., 6"-*12" Duraslot 2½" Slot Riser Submittal Package,* Nov. 2017, retrieved Apr. 27, 2023, from https://www.adspipe.com/water-management-solutions/inlets-and-basins/duraslot-slotted-drain-pipe (10 pages).

Advanced Drainage Systems, Inc., 6"-*24" Duraslot 6" Slot Riser Submittal Package,* Nov. 2017, retrieved Apr. 27, 2023, from https://www.adspipe.com/water-management-solutions/inlets-and-basins/duraslot-slotted-drain-pipe (10 pages).

Advanced Drainage Systems, Inc., 30"-*36" Duraslot 6" Slot Riser Submittal Package,* Nov. 2017, retrieved Apr. 27, 2023, from https://www.adspipe.com/water-management-solutions/inlets-and-basins/duraslot-slotted-drain-pipe (9 pages).

Advanced Drainage Systems, Inc., *ADS, Inc. Drainage Handbook, ADS Duraslot Pipe Specification,* Nov. 2022, retrieved Apr. 27, 2023, from https://www.adspipe.com/water-management-solutions/inlets-and-basins/duraslot-slotted-drain-pipe (2 pages).

Advanced Drainage Systems, Inc., *ADS Duraslot Slotted Drain Brochure,* Nov. 2022, retrieved Apr. 27, 2023, from https://www.adspipe.com/water-management-solutions/inlets-and-basins/duraslot-slotted-drain-pipe (4 pages).

Advanced Drainage Systems, Inc., *Duraslot Installation, Assembly & Field Cut Guide,* Feb. 2022, retrieved Apr. 27, 2023, from https://www.adspipe.com/water-management-solutions/inlets-and-basins/duraslot-slotted-drain-pipe (8 pages).

* cited by examiner

LINEAR OR TRENCH DRAIN SYSTEMS

CROSS REFERENCE TO RELATED APPLICATION

This application is based on and claims benefit of priority of U.S. Provisional Patent Application 63/447,801, filed on Feb. 23, 2023. The content of the foregoing application is incorporated herein by reference in its entirety.

TECHNICAL FIELD

This disclosure relates generally to a drainage apparatus for managing fluid runoff. In particular, this disclosure relates to a trench drain configured to be connected to underlying drainage pipe and a grate for attachment thereto.

BACKGROUND

Trench drains are often installed in heavily trafficked areas, such as roads, driveways, sidewalks, manufacturing facilities and other industrial sites. In these locations, they may be subjected to heavy and variable loading. Broken drain frames and grates can result in excess surface water and unsafe conditions for vehicles and pedestrians. Therefore, a need exists for a drainage apparatus including a frame that can provide adequate load distribution to withstand this traffic.

Additionally, trench drains are often installed in concrete or asphalt. This installation requires the forming and assembly of the drainage components prior to the pour. However, there remain certain disadvantages with existing trench drains because components extend beyond the side frame of the trench drain. For example, some designs include a cross bar extending beyond the sides of the frame to secure the top grate. The installation of these existing trench drains requires more labor and care, through multiple staged pours. It also leaves these components extending beyond the side frame of the trench drain more susceptible to damage in the installation process. Finally, these existing trench drains are inflexible and cannot easily accommodate field changes once the components extending beyond the side frame of the trench drain are cast into the concrete/asphalt. Therefore, a need exists for a drainage apparatus that allows for affixing the grate to a member within the frame.

The disclosed drainage apparatus provides a frame assembly that improves load distribution and allows for attachment of a grate to a cross member located entirely within the frame, overcoming the above and/or other problems in the prior art.

SUMMARY

The disclosed embodiments describe a drainage apparatus for managing fluid runoff. An embodiment of the drainage apparatus may include a trench drain having one or more grates, a frame having a top portion configured to accommodate the one or more grates, a first plurality of plates located within the frame and positioned below the one or more grates, and one or more cross members connected to plates of the first plurality of plates, each of the one or more cross members extending between at least two plates of the first plurality of plates. Advantageously, each of the one or more grates may be secured to a cross member of the one or more cross members.

In some embodiments, the frame may comprise first and second sidewalls spaced apart from one another, the first and second sidewalls being mirror images of one another and each sidewall may include a lower portion, an intermediate portion, and an upper portion, the upper portion corresponding to the top portion of the frame.

Furthermore, the lower portion of the first sidewall may be substantially parallel to the lower portion of the second sidewall and the upper portion of the first sidewall is substantially parallel to the upper portion of the second sidewall. A distance between the lower portion of the first sidewall and the lower portion of the second sidewall may be less than a distance between the upper portion of the first sidewall and the upper portion of the second sidewall.

Furthermore, the intermediate portion of each of the first and second sidewalls may include an angled lower section and a flat upper section, each of the one or more grates being configured to rest on the flat upper sections of the first sidewall and the second sidewall and to abut the top portion of the first sidewall and the top portion of the second sidewall.

In some embodiments, the frame may comprise first and second sidewalls spaced apart from one another, the first and second sidewalls being mirror images of one another. The first and second sidewalls may include a lower portion, an intermediate portion, and an upper portion, the upper portion corresponding to the top portion of the frame. Furthermore, each of the plates of the first plurality of plates abut the first sidewall and the second sidewall, each plate being tapered such that an upper portion of the plate is wider than a lower portion of the plate, the upper portion of the plate being located closer to the grate than the lower portion of the plate.

In some embodiments, the frame may comprise first and second sidewalls spaced apart from one another, the first and second sidewalls being mirror images of one another. The first and second sidewalls may include a lower portion, an intermediate portion, and an upper portion, the upper portion corresponding to the top portion of the frame. Furthermore, the frame may further comprise an end plate tapered such that an upper portion of the end plate is wider than a lower portion of the end plate, the upper portion of the end plate being located closer to the grate than the lower portion of the end plate.

In some embodiments, each of the plates of the first plurality of plates may have slots to accept the cross member. In some embodiments, each of the plates of the first plurality of plates may have tabs allowing for connection of the plate to the frame. In some embodiments, one or more plate of the first plurality of plates does not have a slot to accept the cross member.

In some embodiments, the cross member may include interior threading to accept a second end of a fastener, the first end of the fastener being connected to a grate of the one or more grates. The threading may be in the center of the cross member. The cross member may include a welded hex nut to secure a fastener to the cross member. The cross member may engage with slots in one or more plates of the first plurality of plates. The cross member may protrude through one or more plates of the first plurality of plates.

In some embodiments, the cross member may span between only two plates of the first plurality of plates. In some embodiments, the cross member may include interior threading to accept a second end of a fastener, the first end of the fastener being connected to a grate of the one or more grates. The cross member may be a substantially horizontal plate having edges protruding down from a top surface of the cross member in a central section of the substantially horizontal plate.

In some embodiments, the frame may be connected to a drainage pipe at a bottom of the frame. The connection of the frame to the drainage pipe may be along an entire length of the frame.

Additional features and advantages of the disclosed embodiments will be set forth in part in the description that follows, and in part will be obvious from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

DETAILED DESCRIPTION

Example embodiments are described with reference to the accompanying drawings.

The disclosed embodiments improve deficiencies of existing drainage apparatuses by providing for better load distribution throughout the geometry and spacer layout. Additionally, grate connections according to embodiments of the disclosure allow for easier field installation and flexibility by accommodating grate connection to a cross member located entirely inside the frame of the drainage apparatus.

The figures detailed below depict these improvements in the form a linear trench drainage apparatus with mirrored sidewalls. However, the disclosure is not limited to the depicted embodiments. It is contemplated that drains of different geometries could incorporate the claimed features and similar benefits would result from doing so.

Figure 1A:
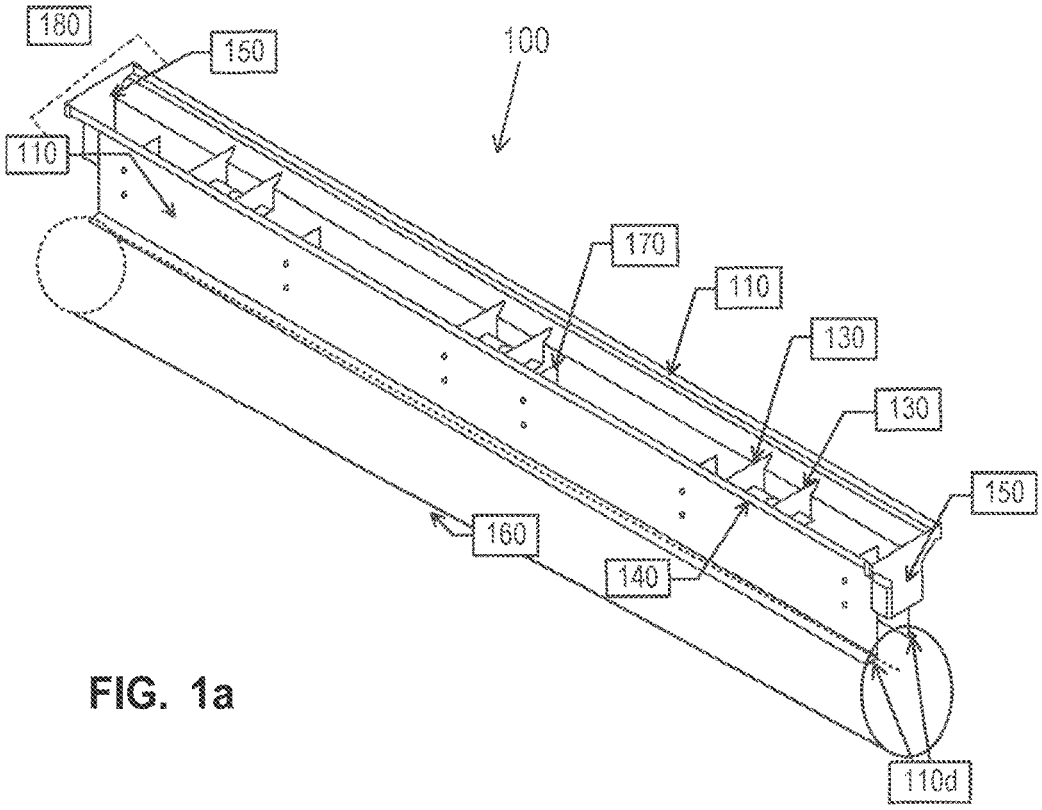
FIG. 1*a* depicts an isometric view of a drainage apparatus without the grate affixed to the top.
Figure 1B:
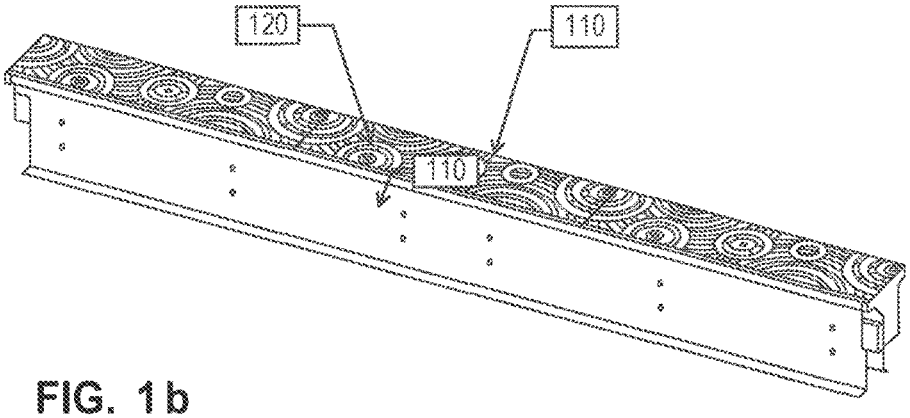
FIG. 1*b* depicts an isometric view of the drainage apparatus with the grate affixed to the top.

FIG. 1*a* and FIG. 1*b* depict an isometric view of a drainage apparatus 100, without and with a grate 120. Drainage apparatus 100 may be for receiving fluid runoff, such as stormwater, rainwater, flooding, water from cooling machinery, washing equipment, or any fluid that tends to pool. Grate 120, shown in FIG. 1*b*, protects the drainage apparatus 100 by allowing water to run into the drainage apparatus 100 while preventing debris from clogging the drainage apparatus 100. In some embodiments, as shown in FIG. 1*b*, the grate 120 may be a rectangular shape. In some embodiments, grate 120 may be in the shape of a circle, oval, square, or rectangle, or may be asymmetrically shaped. The drainage apparatus 100 may include multiple grates 120 and each grate may abut one or more adjacent grates 120 or may be offset from one or more adjacent grates 120. Grate 120 may have openings in various patterns to meet the installation fluid flow requirements, expected flow characteristics, and/or aesthetic requirements. In an embodiment, the grate may be five inches wide, though other dimensions may be used.

Drainage apparatus 100 may include a frame 180 that contains fluid runoff, comprising sidewalls 110 and end plates 150. Frame 180 may be connected to grate 120 and may be configured to divert fluid runoff filtered through grate 120 down to a lower drainage pipe 160. Accordingly, fluid runoff may run through grate 120, between sidewalls 110 and end plates 150, and into lower pipe 160 where it may continue flowing through more pipes or other drainage structures until it reaches an end destination (e.g., ground, stream, treatment facility, etc.). As shown in FIGS. 1*a* and 1*b*, in some embodiments, sidewalls 110 may include a first and second sidewall spaced apart from each other and being mirror images of one another. In some embodiments, for example, first and second sidewalls may be parallel to on another. In other embodiments, not depicted, however, sidewall 110 may be a single continuous wall. For example, sidewall 110 may be a single continuous wall connected to a circular grate 120 of an inline drain. Additional details for examples of sidewall configurations are provided below.

In some embodiments, sidewalls 110 and/or grates 120 may be formed of injection-molded plastic material, such as polyethylene, polypropylene, or PVC (polyvinyl chloride) materials. In some embodiments, sidewalls 110 and/or grates 120 may be formed of a metal, such as a galvanized steel, cast iron, or aluminum. Sidewalls 110 and grates 120 may be made of any material with sufficient strength to handle the necessary loads that will be placed on drainage apparatus 100. Further, sidewalls 110 and grates 120 may be made of the same or different material.

In some embodiments, lower drainage pipe 160 may be a slotted drainage pipe and may include a slot opening where lower drainage pipe 160 connects to sidewalls 110. As further detailed below, sidewalls 110 may include a bottom flange 110*d* that abuts the inside of lower drainage pipe 160. In some embodiments, the distance between the sidewalls at the slot opening may be between 1 inches and 4 inches. As shown in FIG. 1*a*, a connection of the frame 180 to lower drainage pipe 160 may be along an entire length of the frame 180. In other embodiments, lower drainage pipe 160 may not be slotted and the inlet of lower drainage pipe 160 may be affixed to frame 180 of drainage apparatus 100 through different means. Lower drainage pipe 160 may have a diameter between 2.5" and 36".

Lower drainage pipe 160 may be made of corrosion resistant HDPE conveyance pipe, reinforced concrete pipe, ductile iron pipe, PVC pipe, or any other material suitable to withstanding the flow and/or corrosive nature of the fluid runoff. In one embodiment, lower drainage pipe 160 may be a slotted HDPE conveyance pipe with a smooth interior and annular exterior corrugations. In other embodiments, lower drainage pipe 160 is not a separate pipe but a channel formed by sidewalls 110 of drainage apparatus 100.

Drainage apparatus 100 may further include plates 130 and 170, as shown in FIG. 1*a*, to act as spacers and help resist deformation of sidewalls 110 under traffic loads. In some embodiments, plate 130 is an upper spacer and abuts the inside of sidewalls 110 closer to grate 120 than the plate 170. Plate 170 may be a lower spacer that abuts the inside of sidewalls 110 closer to lower drainage pipe 160 than plate 130. In some embodiments, there is only a single type of plate instead of the upper and lower plates (130, 170). In some embodiments, the plates (130, 170) may be substantially parallel to each other. The faces of the plates (130, 170) may be substantially perpendicular to the faces of sidewalls 110 or the faces of the plates (130, 170) may be angled to direct the fluid in a preferred direction of flow. The plates (130, 170) may be spaced along the length of frame 180 as necessary to provide sufficient reinforcement to drainage apparatus 100. Additionally, and/or alternatively, plates 130 may be spaced as necessary to securely affix cross members 140 to grates 120 as described in further detail below. While in the embodiment shown in FIG. 1*a* plates (130, 170) act as spacers and provide support for the sidewall, in other embodiments bars, rods or other structural members may be used in lieu of plates to provide structural support for sidewalls 110 and/or to provide an attachment point for the cross members 140.

In some embodiments, upper plates 130 and lower plates 170 may be made of a plastic material, such as polyethylene, polypropylene, or PVC (polyvinyl chloride) materials. In some embodiments the upper plates 130 and lower plates 170 may be formed of a metal, such as a galvanized steel, cast iron, or aluminum. The plates (130, 170) may be made of any material that can provide structural support to sidewalls 110 and/or provide an attachment point for cross members 140.

End plate 150 may be installed at the end of drainage apparatus 100 and may be connected to sidewalls 110. End plate 150 may cover the space between sidewalls 110 and prevent fluid from leaking out as it flows to lower drainage pipe 160. In some embodiments, end plate 150 may be made of the same material as upper plate 130 and/or lower plate 170. In other embodiments, end plate 150 may be made of any material that can cover the space between sidewalls 110. In other embodiments, sidewalls 110 are continuous and there is no separate end plate 150.

Drainage apparatus 100 may further include cross members 140, as detailed in FIG. 1*a*, which span between plates 130 and allow for fastening grates 120 to frame 180 of drainage apparatus 100. Cross members 140 may be made of a plastic material, such as polyethylene, polypropylene, or PVC (polyvinyl chloride) materials. In some embodiments, cross member 140 may be formed of a metal, such as a galvanized steel, cast iron, or aluminum. Cross members 140 may be made of any material with sufficient strength to secure grate 120, shown in FIG. 1*b*.

As described above, installation of a drainage apparatus, such as a trench drain, may be difficult and labor-intensive. To install drainage apparatus 100, a trench must be dug and base material must be placed at the bottom of the trench. Then the drainage apparatus and connected drainage pipe must be installed, protected, and braced. The trench is then backfilled with the appropriate material depending on the loading requirements of the application. In some embodiments, for example in a heavy traffic installation, drainage apparatus 100 may be installed in concrete. In some embodiments, drainage apparatus 100 may be installed in crushed rock, gravel, asphalt, or any other backfill material capable of withstanding the relevant loading and holding drainage apparatus 100 in place. Some existing trench drain designs include components for fixing the grate to the frame that extend beyond the sides of the frame. For example, some trench drains include a cross bar extending beyond the sides of the frame to secure the grate. Installing drains with these external components can be labor-intensive. The installation may require more care in framing, multiple staged concrete pours, and may not easily accommodate field changes once cast in place. Furthermore, the external components may be more susceptible to damage during the installation process.

Figure 2:
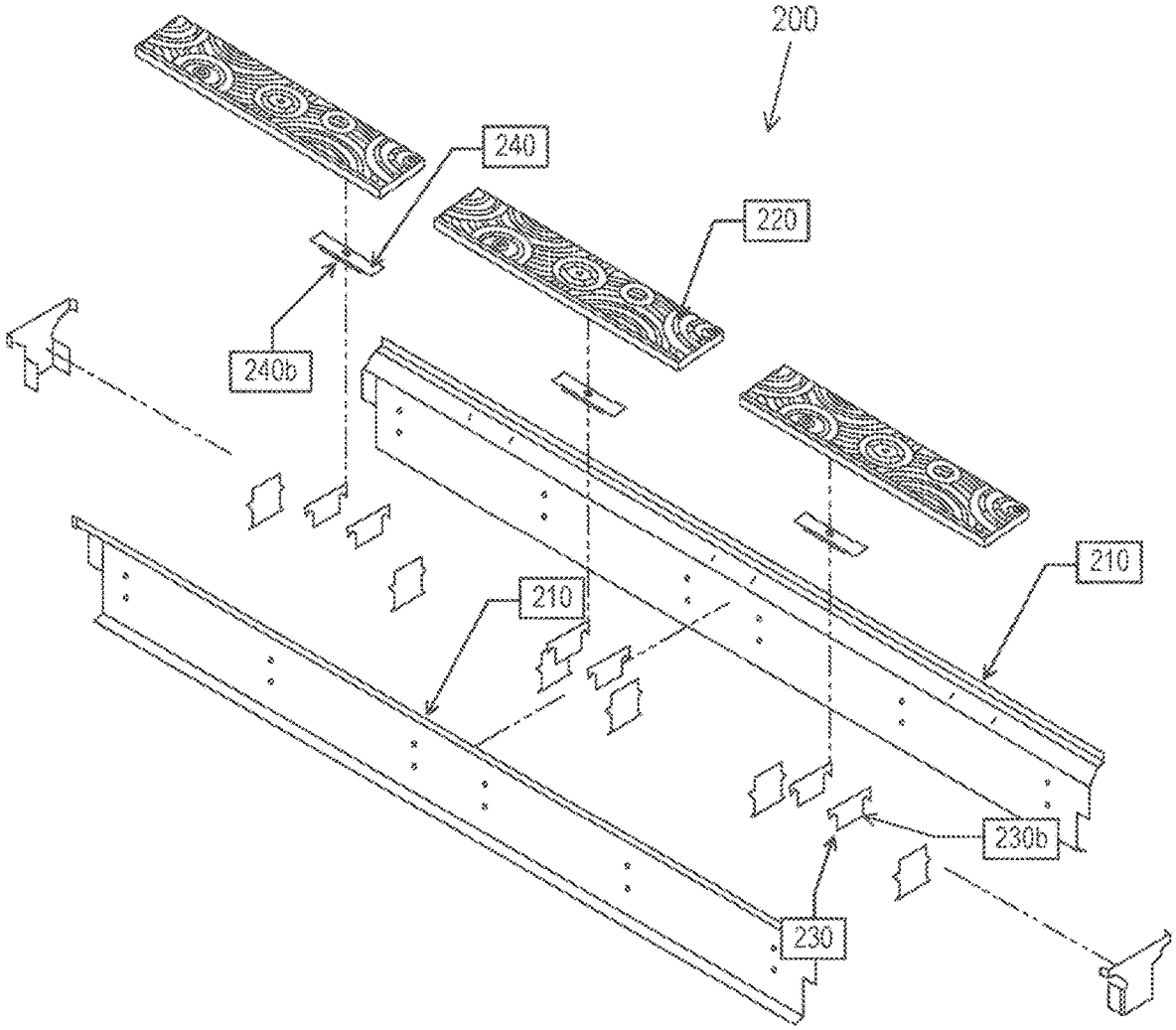
FIG. 2 depicts an exploded view of the drainage apparatus depicted in FIG. 1*b*.

FIG. 2 depicts an exploded view of drainage apparatus 200 showing how drainage apparatus 200 solves these problems by permitting grates 220 to be secured to cross members 240 located entirely inside and between sidewalls 210 of drainage apparatus 200. In some embodiments, cross members 240 may span between two plates 230. In other embodiments, cross members 240 may span between more than two plates 230. Cross members 240 may vary in length. In some embodiments, a length of one or more cross members 240 may be less than a length of one or more grates 220. In other embodiments, one or more cross members 240 may have a length that is the same as a length of one or more grates 220. And in yet other embodiments, one or more cross members 240 may have a length that is greater than a length of one or more grates 220. In some embodiments, cross members 240 may have a length between approximately 4 inches and approximately 10 inches. Cross member 240 may be a plate, bar, rod, or any other member that is able to span between plates 230 and fasten to grate 220. A face of cross member 240 may be generally parallel to a face of grate 220.

Plates 230 may include slots 230*b* which permit cross members 240 to slide through the plates 230 and to be supported by plates 230. Slots 230*b* may be created by stamping, cutting, milling, drilling or any other machining or manufacturing technique for creating cutouts, opening, or holes. Alternatively, slots 230*b* may be created with a mold during the manufacturing of plate 230. In other embodiments, cross member 240 may be welded, fastened, or otherwise secured to plates 230. In other embodiments, cross member 240 may be part of one or more plates 230 and may be constructed of the same piece of continuous material. At least one fastener may connect grate 220 to cross member 240. A first end of the fastener may be connected to grate 220 and a second end of the fastener may be connected to cross member 240.

As further detailed below, cross member 240 may have edges 240*b* protruding down from a top surface of the cross member in a central section, allowing the cross member 240 to be locked in place when the ends are slid between the plate slots 230*b*. Additionally, and/or alternatively, cross member 240 may have edges that are wider than the width of the slots 230*b* and allow the cross member to be locked into position between the plates 230. The cross member 240 may have other means to secure the connection with the plates 230. For example, the cross member 240 may have tabs, lips, brackets and/or any other features that allow for the cross member 240 to be secured in place between the plates 230.

The above embodiments provide for flexibility in the installation process by keeping the cross members 240, used to fasten the grates, entirely with the sidewalls 210 of drainage apparatus 200. Therefore, the installation process is made easier because less caution needs to be taken in framing and pouring the concrete. Additionally, the exterior of drainage apparatus 200 is easier to protect in the framing process. Furthermore, drainage apparatus 200 can more easily accommodate field changes because it reduces the external components embedded in the surrounding backfill material (e.g. concrete).

As described above, the drainage apparatus may be subjected to heavy and variable loading, such as through vehicular traffic. For example, the drainage apparatus may be installed at airports, parking garages, industrial plants, or other locations where it might receive heavy vehicular traffic. Additionally, and/or alternatively, the drainage apparatus may be subjected to heavy pedestrian traffic. This requires drainage apparatus to be constructed in a manner that adequately distributes the load forces.

Figure 3:
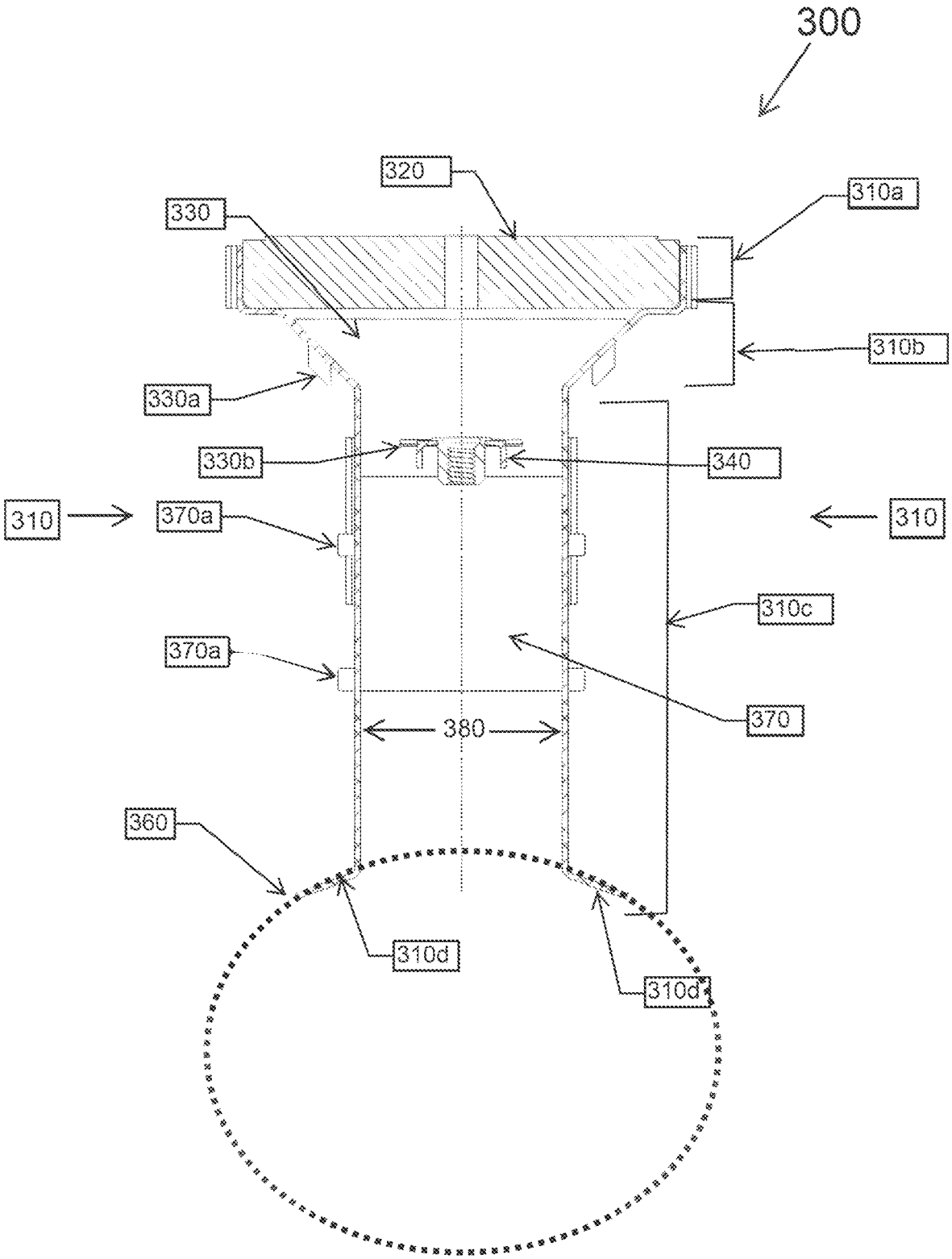
FIG. 3 depicts a cross section of a drainage apparatus.

FIG. 3 depicts a cross section of a drainage apparatus 300 that provides support for the grate 320 and adequately distributes the load on the grate 320 to avoid damage to drainage apparatus 300. Drainage apparatus 300 may include first and second sidewalls 310 spaced apart from one another. First and second sidewalls 310 may be mirror images of one another. In some embodiments, each sidewall 310 includes a lower portion 310*c*, an intermediate portion 310*b*, and an upper portion 310*a*. In some embodiments, lower portion 310*c* of the first sidewall is substantially parallel to lower portion 310*c* of the second sidewall and upper portion 310*a* of the first sidewall is substantially parallel to upper portion 310*a* of the second sidewall. In other embodiments, first and second sidewalls 310 may be substantially parallel to one another along all portions of the first and second sidewalls.

As previously mentioned, in some embodiments, lower drainage pipe 360 may be a slotted pipe with a narrow opening to accept the drainage apparatus frame 380 (comprising sidewalls 310 and end plates (not shown in FIG. 3)). Sidewalls 310 may include bottom flanges 310*d* that abut the inside of lower drainage pipe 360 and allow for water flow from frame 380 into drainage pipe 360. However, a larger grate 320 may be desired to better accommodate the fluid runoff or to better interface with the surrounding terrain. Therefore, the drainage apparatus 300 may need to be narrower at the bottom near lower drainage pipe 360 and wider at the top near grate 320. FIG. 3 depicts a framing geometry that meets these requirements. As shown, a distance between lower portion 310*c* of the first sidewall and lower portion 310*c* of the second sidewall may be less than a distance between upper portion 310*a* of the first sidewall and upper portion 310*a* of the second sidewall.

Furthermore, an intermediate portion 310*b* of the first and second sidewalls may include an angled section to accommodate different widths of the drainage apparatus frame 380. Intermediate portion 310*b* may also include a flat upper section that supports the bottom of grate 320. Grate 320 may rest on the flat upper section of intermediate portions 310*b* and may abut the interior of the first and second sidewalls 310 at upper portions 310*a*. In other embodiments, grate 320 may rest on top of sidewalls 310, may be supported by flat sections in upper portions 310*a*, may be fastened to sidewalls 310 with a bracket, or may be otherwise fixed to sidewalls 310. While each sidewall 310 in FIG. 3 is illustrated as a single component comprising a continuous piece of material, the disclosure is not so limited. In some embodiments, sidewalls 310 may comprise multiple components secured together. In some embodiments, sidewalls 310 may have a height between approximately 2.5 inches and approximately 36 inches to accommodate different installation requirements.

Plates 330 act as spacers and continuously abut the first and second sidewalls 310 to provide adequate structural support for the frame 380. To maintain this connection to the sidewalls 310, each of plates 330 may include a tapered section such that an upper portion of the plate is wider than a lower portion. In some embodiments, the tapering may be at an angle that allows the plate 330 to maintain contact with an interior of each of the first and second sidewalls 310. For example, as shown in FIG. 3, an upper portion of plate 330, including tabs 330*a*, may be tapered at the same angle as sidewall intermediate portion 310*b*. In other embodiments, the plates 330 may include any geometry that provides sufficient support for the sidewalls 310, which may vary based on installation characteristics. In some embodiment, tabs 330*a* allow for the plates 330 to be connected to sidewalls 310. Any number of tabs 330*a* may be included to allow for connection to sidewalls 310. In some embodiments, the plates 330 may be connected to sidewalls 310 through welding, adhesives, fasteners, and or any other means that provides a secure connection between sidewalls 310 and the plates 330. In some embodiments, an end plate (shown in earlier figures) installed at the end of drainage apparatus 300 may have similar geometry to the plates 330, including tapering, such that an upper portion of the end plate is wider than a lower portion of the end plate. In other embodiments, the end plate may have any geometry that caps the end of drainage apparatus 300 and helps to minimize leakage.

Plates 370 also act as spacers and may be configured to continuously abut the first and second sidewalls 310 to provide adequate structural support for the frame 380. Similar to plate 330, the angled shape of plate 370 may provide sustained contact with an interior of the first and second sidewalls 310. For example, plate 370 may have vertical sidewalls to match the inside of sidewall lower portion 310*c*. In other embodiments, plates 370 may include any geometry that provides sufficient support for the sidewalls 310, which may vary based on installation characteristics. In some embodiments, tabs 370*a* allow for the plates 370 to be connected to sidewalls 310. Any number of tabs 370*a* may be included to allow for connection to sidewalls 310. In some embodiments, the plates 370 may be connected to sidewalls 310 through welding, adhesives, fasteners, and or any other means that provides a secure connection between sidewalls 310 and the plates 370.

As shown above, drainage apparatus 300 provides for structural support of grate 320 which is wider than a slot inlet of lower drainage pipe 360. Furthermore, the geometry of the plates (330, 370) provides support for the sidewalls 310 to avoid deformation. Therefore, the disclosed drainage apparatus 300 embodiments provide for better load distribution and can withstand installation in heavily trafficked areas. Further, as detailed above, cross member 340 may securely affix the grate 320 to prevent movement of the grate 320. A first end of a fastener may be connected to grate 320 and a second end of the fastener may be connected to cross member 340

Figure 4A:
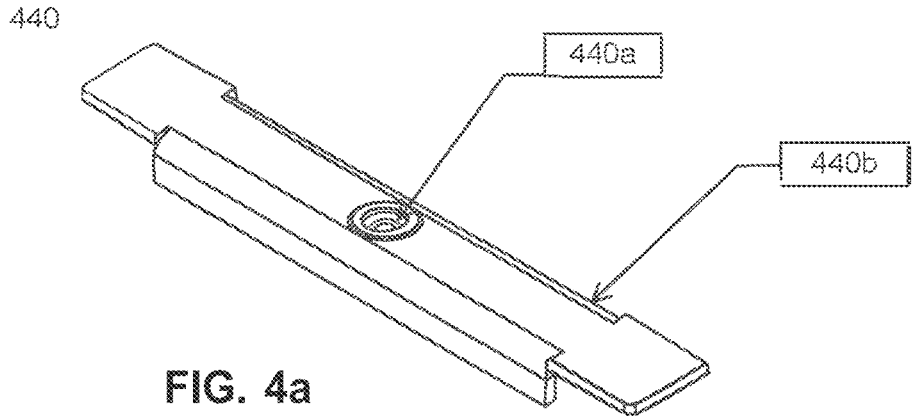
FIG. 4*a* depicts an embodiment of a cross member.
Figure 4B:
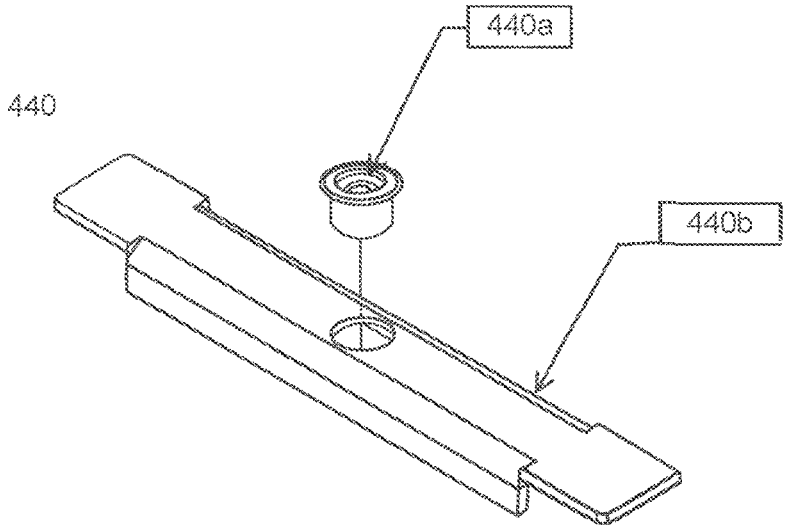
FIG. 4*b* depicts this embodiment with the fastener receiver separate.

FIG. 4*a* and FIG. 4*b* depict an embodiment of a cross member 440. Cross member 440 may include interior threading 440*a* to accept the second end of the fastener. In this embodiment, the interior threading 440*a* is on a rivet nut installed in the center of the cross member 440. However, any number and pattern of interior threading 440*a* locations may be provided.

Figure 5A:
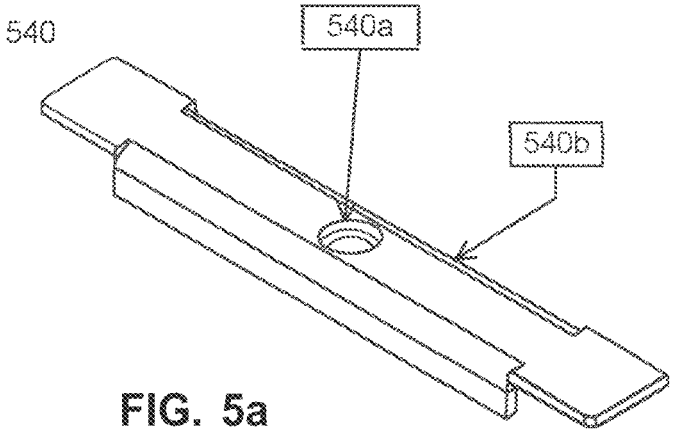
FIG. 5*a* depicts another embodiment of a cross member.
Figure 5B:
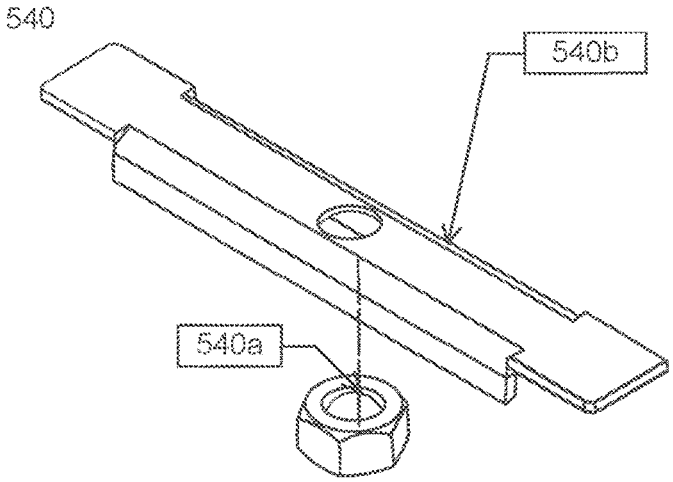
FIG. 5*b* depicts this embodiment with the fastener receiver separate.

FIG. 5*a* and FIG. 5*b* depict an embodiment of a cross member 540. Cross member 540 may include interior threading 540*a* to accept the second end of the fastener. In this embodiment, the interior threading 540*a* is on a welded hex nut installed in the center of the cross member 540. However, any number and pattern of interior threading 540*a* locations may be provided. Further, the interior threading 540*a* may be on a different type of fastener receiver than a rivet nut or welded hex nut. In some embodiments, cross member 540 may include a clinch nut, u-nut, knurled head nut, or any other type of fastener receiver to accept the second end of the fastener. In some embodiments, the material from which the cross member 540 is formed may be directly threaded to accept the second end of the fastener and a separate fastener receiver is not necessary.

The disclosure, with explicit and implicit variations and advantages, has been described and illustrated with respect to several exemplary embodiments. Those embodiments should be considered illustrative and not restrictive possible examples and/or representations, and various changes, omissions and/or additions may be made, and, equivalents may be substituted for elements or exemplary embodiments. Unless specifically stated otherwise: any use of words such as "preferred" and variations suggest a feature or combination which is desirable but which is not necessarily mandatory, and, use of terms first, second, etc., do not denote order or importance. Thus, embodiments lacking any such preferred feature or combination may be within the scope of the claims which follow. Persons skilled in the art may make various changes in form and detail of the invention embodiments which are described, without departing from the spirit and scope of the claimed invention. Modifications and adaptations of the embodiments will be apparent from consideration of the specification and practice of the disclosed embodiments. For example, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents may be resorted to, falling within the scope of the disclosure.

What is claimed is:

1. An elongate or linear drain, comprising:

at least one elongate grate (320);

an elongate frame (380) including first and second spaced apart sidewalls (310) defining a channel into which liquid draining through the at least one elongate grate (320) may flow, the elongate frame (380) having a top portion capable of supporting the at least one elongate grate (320);

a first plurality of plates disposed within the channel, below the at least one elongate grate (320), each of the plates of the first plurality of plates extending between and abutting the first and second spaced apart sidewalls (310); and at least one cross member (340) spaced apart downwardly from tops of, and extending between and connected to central portions of at least two plates of the first plurality of plates.

2. The elongate or linear drain of claim 1, wherein the first and second sidewalls are mirror images of one another.

3. The elongate or linear drain of claim 1, wherein each of the first and second sidewalls includes a lower portion, an intermediate portion, and an upper portion, the upper portion corresponding to the top portion of the elongate frame.

4. The elongate or linear drain of claim 3, wherein the lower portion of the first sidewall is substantially parallel to the lower portion of the second sidewall and the upper portion of the first sidewall is substantially parallel to the upper portion of the second sidewall.

5. The elongate or linear drain of claim 4, wherein a distance between the lower portion of the first sidewall and the lower portion of the second sidewall is less than a distance between the upper portion of the first sidewall and the upper portion of the second sidewall.

6. The elongate or linear drain of claim 5, wherein the intermediate portion of each of the first and second sidewalls includes an angled lower section and a flat upper section, each of the at least one grates being configured to rest on the flat upper sections of the first sidewall and the second sidewall and to abut the top portion of the first sidewall and the top portion of the second sidewall.

7. The elongate or linear drain of claim 3, wherein each of the plates of the first plurality of plates being tapered such that an upper portion of the plate is wider than a lower portion of the plate, the upper portion of the plate being located closer to the grate than the lower portion of the plate.

8. The elongate or linear drain claim 3, wherein the elongate frame further comprises an end plate tapered such that an upper portion of the end plate is wider than a lower portion of the end plate, the upper portion of the end plate being located closer to the at least one elongate grate than the lower portion of the end plate.

9. The elongate or linear drain of claim 1, wherein each of the plates of the first plurality of plates has slots to accept the at least one cross member.

10. The elongate or linear drain of claim 1, wherein each of the plates of the first plurality of plates has tabs allowing for connection of the plate to the elongate frame.

11. The elongate or linear drain of claim 10, wherein each of the plates of the first plurality of plates has slots to accept the at least one cross member.

12. The elongate or linear drain of claim 1, wherein the at least one cross member includes interior threading to accept a second end of a fastener, the first end of the fastener being connected to the at least one elongate grate.

13. The elongate or linear drain of claim 12, wherein the threading is in the center of the cross member.

14. The elongate or linear drain of claim 13, wherein the at least one cross member includes a welded hex nut to secure the fastener to the cross member.

15. The elongate or linear drain of claim 12, wherein the at least one cross member engages with slots in at least two of the first plurality of plates.

16. The elongate or linear drain of claim 15, wherein the at least one cross member protrudes through the at least two plates of the first plurality of plates.

17. The elongate or linear drain of claim 12, wherein the at least one cross member is a substantially horizontal plate having edges protruding down from a top surface of the cross member in a central section of the substantially horizontal plate.

18. The elongate or linear drain of claim 1, wherein the at least one cross member spans between only two plates of the first plurality of plates.

19. The elongate or linear drain of claim 1, wherein the frame is connected to a drainage pipe at a bottom of the elongate frame.

20. The elongate or linear drain of claim 19, wherein the connection of the elongate frame to the drainage pipe is along an entire length of the elongate frame.

* * * * *